US008598862B2

(12) United States Patent
Nikolov et al.

(10) Patent No.: US 8,598,862 B2
(45) Date of Patent: Dec. 3, 2013

(54) STARTUP CIRCUIT FOR LOW VOLTAGE CASCODE BETA MULTIPLIER CURRENT GENERATOR

(75) Inventors: Ludmil Nikolov, Chippenham (GB); Carlos Calisto, Swinden (GB)

(73) Assignee: Dialog Semiconductor GmbH., Kirchheim/Teck-Nabern (DE)

( * ) Notice: Subject to any disclaimer, the term of this patent is extended or adjusted under 35 U.S.C. 154(b) by 357 days.

(21) Appl. No.: 12/932,995

(22) Filed: Mar. 11, 2011

(65) Prior Publication Data

US 2012/0229117 A1 Sep. 13, 2012

(30) Foreign Application Priority Data

Mar. 7, 2011 (EP) ..... 11368007

(51) Int. Cl.
*G05F 3/20* (2006.01)

(52) U.S. Cl.
USPC ..... 323/315; 323/311

(58) Field of Classification Search
USPC ..... 323/311–317
See application file for complete search history.

(56) References Cited

U.S. PATENT DOCUMENTS

| | | | |
|---|---|---|---|
| 4,839,535 | A | 6/1989 | Miller |
| 5,061,862 | A | 10/1991 | Tamagawa |
| 5,686,825 | A | 11/1997 | Suh et al. |
| 5,889,393 | A | 3/1999 | Wrathall |
| 6,118,266 | A | 9/2000 | Manohar et al. |
| 6,150,872 | A | 11/2000 | McNeill et al. |
| 6,191,644 | B1 | 2/2001 | Srinath et al. |
| 6,392,470 | B1 | 5/2002 | Burstein et al. |
| 6,525,598 | B1 * | 2/2003 | Croman ..... 327/543 |
| 6,617,835 | B2 | 9/2003 | Nishimura |
| 6,815,938 | B2 | 11/2004 | Horimoto |
| 6,894,473 | B1 | 5/2005 | Le et al. |
| 7,265,529 | B2 | 9/2007 | Nazarian |
| 7,286,002 | B1 | 10/2007 | Jackson |
| 7,307,486 | B2 | 12/2007 | Pernia et al. |

(Continued)

OTHER PUBLICATIONS

European Search Report—11368007.8-1239 Mail date Nov. 10, 2011, Dialog Semiconductor GmbH.

(Continued)

*Primary Examiner* — Adolf Berhane
*Assistant Examiner* — Yemane Mehari
(74) *Attorney, Agent, or Firm* — Saile Ackerman LLC; Stephen B. Ackerman

(57) ABSTRACT

A self-biased reference circuit device (100) includes a first cascode current mirror (116), a second cascode current mirror (118), and a startup circuit (108). The first cascode current mirror (116) is capable to generate a first bias voltage (136) and a second bias voltage (140) in response to a first current and to generate a second current in response to the first and second bias voltages. The second cascode current mirror (118) is capable to generate a third bias voltage (164) in response to the second current, to generate a fourth bias voltage (168) in response to a third current, and to generate the first current in response to the third and fourth bias voltages. The startup circuit includes a first switch (188) and a second switch (196). The first switch (188) is capable to connect the first bias voltage (136) and fourth bias voltage (168) during startup. The second switch (196) is capable to connect the third bias voltage (164) and an inner drain-source connection (130) in the output stage of the first cascode current mirror (116) during startup.

23 Claims, 6 Drawing Sheets

(56) References Cited

U.S. PATENT DOCUMENTS

| | | | |
|---|---|---|---|
| 7,372,316 | B2 | 5/2008 | Chatterjee et al. |
| 7,429,854 | B2 | 9/2008 | Kimura |
| 7,545,227 | B2 | 6/2009 | Pernia et al. |
| 7,554,313 | B1 | 6/2009 | Leitner |
| 7,583,070 | B2 | 9/2009 | Nazarian |
| 7,724,075 | B2 | 5/2010 | Yang et al. |
| 7,724,551 | B2 | 5/2010 | Yanagida et al. |
| 7,728,574 | B2 | 6/2010 | Kalyanaraman |
| 7,755,419 | B2 | 7/2010 | Rao et al. |
| 2009/0160419 | A1 | 6/2009 | Jang |
| 2009/0295360 | A1 | 12/2009 | Hellums |
| 2010/0090014 | A1 | 4/2010 | Okuda |
| 2010/0164467 | A1 | 7/2010 | Jo |
| 2010/0164609 | A1 | 7/2010 | Yoo |
| 2010/0166031 | A1 | 7/2010 | Li et al. |
| 2010/0237848 | A1 | 9/2010 | Kalyanaraman |

OTHER PUBLICATIONS

"Fast Startup CMOS Current References," by Soumyajit Mandal et al., 2006 IEEE, ISCAS 2006, 0-7803-9390-2/06, pp. 2845-2848.

"A 5-bits Precision CMOS Bandgap Reference with On-Chip Bi-directional Resistance Trimming," by Noubuisi Ekekwe et al., 2008 IEEE, 978-4244-2167-1/08, pp. 257-260.

"A Dynamic Start-Up Circuit for Low Voltage CMOS Current Mirrors with Power-Down Support," by Nima Maghari et al., 2005 IEEE, pp. 4265-4268.

"Use of a Continuatin Method for Analyzing Startup Circuits," by Wen Hou et al., 978-1-4244-5309-2/10, pp. 1527-1530, 2010.

* cited by examiner

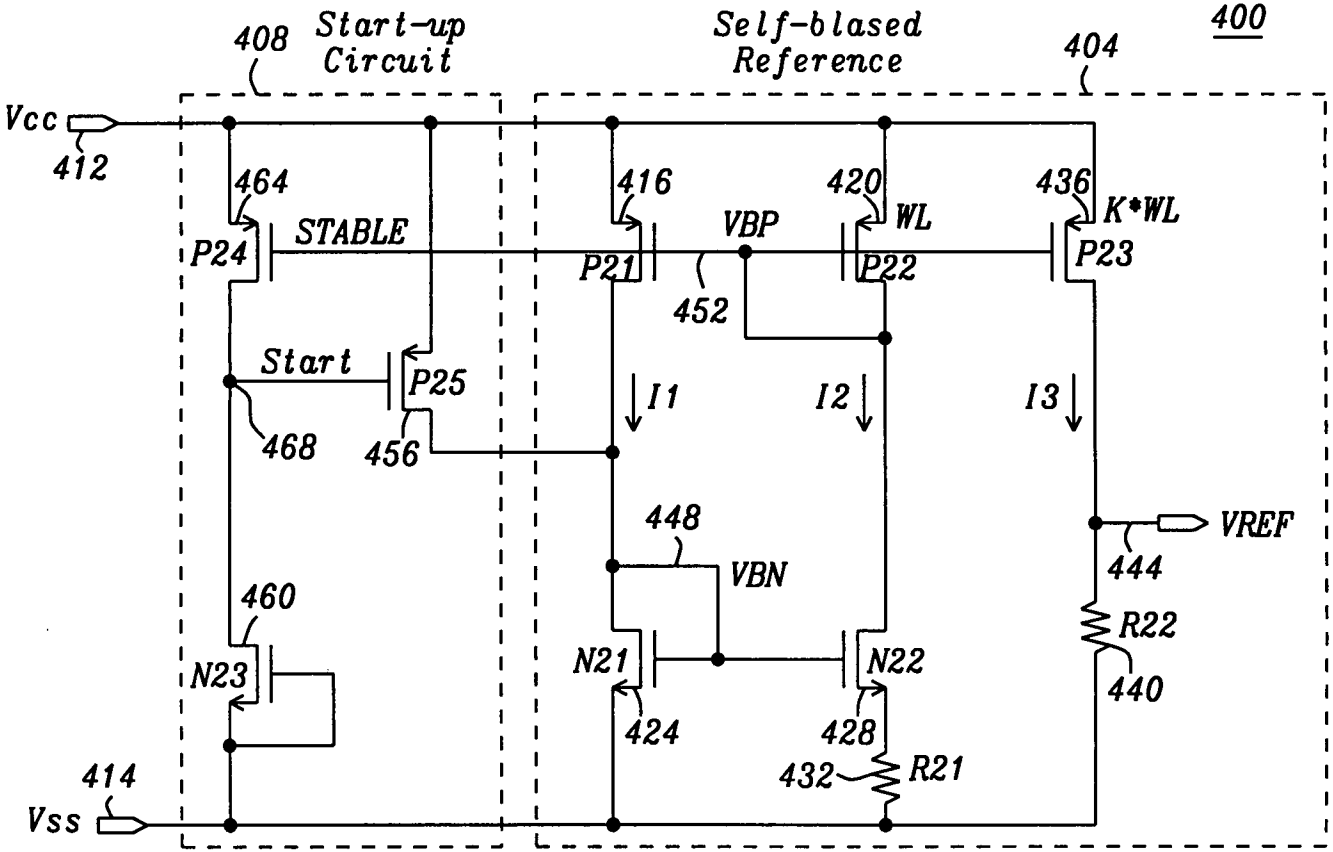
FIG. 5 – Prior Art

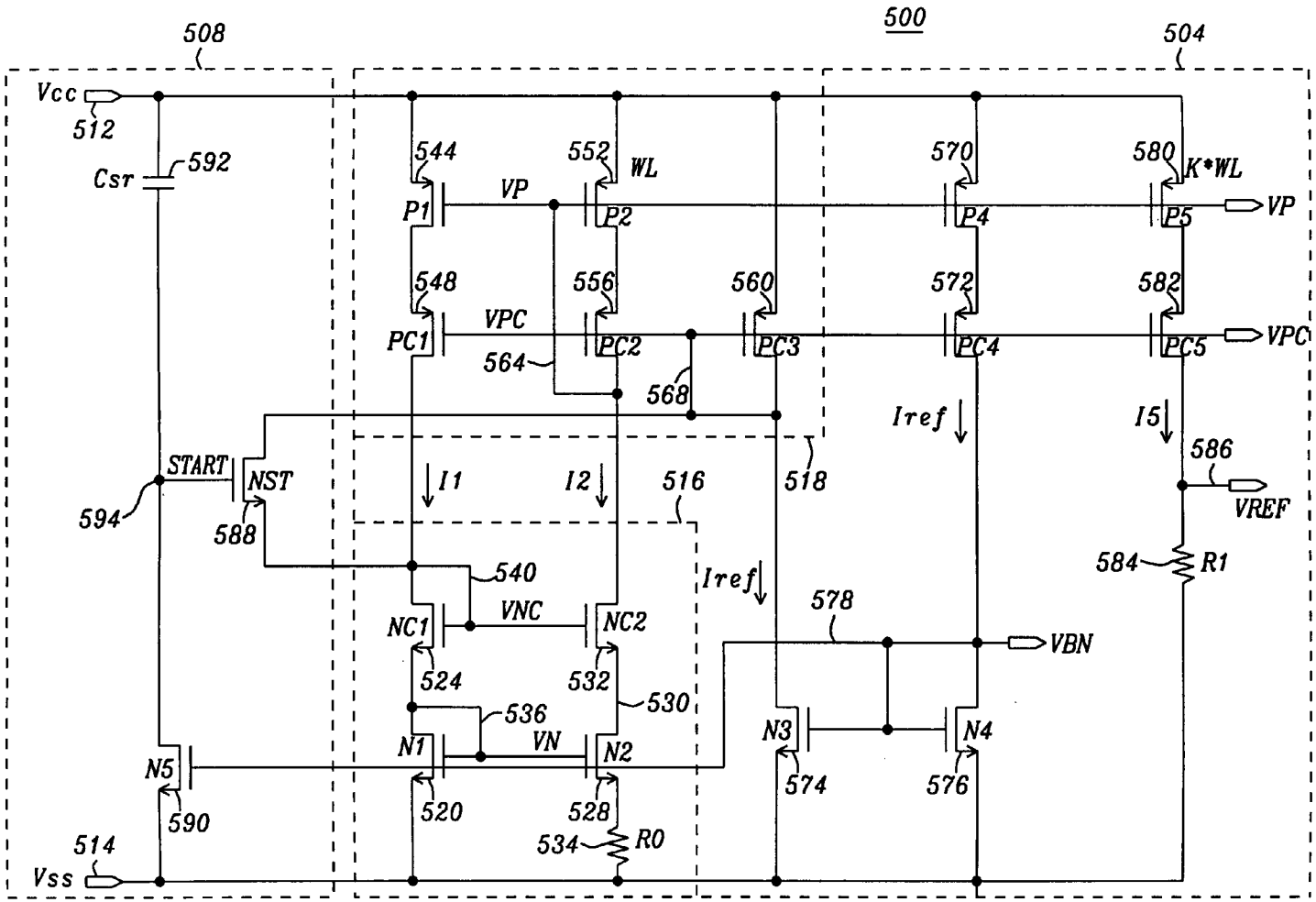
FIG. 6 – Prior Art

STARTUP CIRCUIT FOR LOW VOLTAGE CASCODE BETA MULTIPLIER CURRENT GENERATOR

FIELD OF THE INVENTION

The invention relates generally to self-biased reference circuits and, more particularly, to a startup circuit for a low voltage cascode beta-multiplier current generator.

BACKGROUND OF THE INVENTION

Reference circuits are frequently found in integrated circuit devices. A reference circuit provides a voltage or current level of known value. This voltage or current reference may be duplicated, or mirrored, for use across the integrated circuit. References are used to establish on-chip power supply levels, signal thresholds, and to insure stable operation of analog amplifiers, among other known applications.

Reference circuits can be categorized as non-biased or self-biased. In a non-biased circuit, the reference is generated by simply conducting current through a device or series of devices. For example, current may be conducted through a series of resistors in a voltage divider. Alternatively, current may be conducted through a diode or series of diodes. A diode drop, or summation of diode drops, is used as a reference voltage. These non-biased reference circuits are simple to construct and typically yield predictable results. However, non-biased references may suffer from several disadvantages. For example, resistor dividers are directly dependent on variations in supply voltages. Further, the current draw for the reference circuit can be large unless very high value resistors are used, and such resistors typically require large circuit areas to construct. Diode series are more predictable than resistor dividers but current draw is still an issue. Hence is can be difficult to construct non-biased reference circuits with low power consumption.

Self-biased circuits use transistor biasing, rather than voltage division, to establish the reference current. Ideally, a self-biased circuit is designed such that the voltage or current reference depends solely on device parameters and layout ratios while cancelling out dependence on the supply voltage. The resulting reference current or voltage is said to have higher output impedance since it is less susceptible to changes in the supply voltage. In addition, a self-biasing circuit is designed to operate with low power consumption. Generally, self-biased reference circuits are more suited to low power applications.

A well-known self-biased reference circuit is the beta-multiplier. In the beta-multiplier, a PMOS mirror circuit and a NMOS mirror circuit are arranged such that each mirror circuit replicates the current from the other circuit. Further, one of the mirrors includes a mismatched output transistor—one have a larger width than the input transistor—coupled to an output source resistor. The operating point of the circuit is mathematically determined by the beta (β) of the transistors, the width ratio of the mismatched transistors, and the size of the resistor. The beta-multiplier circuit thereby generates a current reference substantially independent of the voltage supply and with relatively low power consumption.

A significant issued with self-biased reference circuits in general, and beta-multiplier circuits in particular, is that they have two stable DC operating states. One state is an active state where both of the current mirrors conduct current and the desired current reference is generated. The other state is an inactive state where both current mirrors are OFF and no current reference is generated. To avoid the inactive state, it is common in the art to use a dedicated start-up circuit to force the self-biased reference circuit into the active state during integrated circuit power-up. After a start-up operation is completed, the start-up circuit is shut off. The active state, self-biased reference circuit is then allowed to settle to its stable operating point.

U.S. Pat. No. 7,755,419 to Rao, el al, discloses an implementation of a beta-multiplier reference circuit with a start-up circuit. Referring now to FIG. 5, a circuit schematic block diagram illustrates this prior art, self-biased reference circuit 400. The circuit 400 includes a reference circuit 404 and a start-up circuit 408. The circuit 400 is powered from a high voltage supply $V_{CC}$ 412 and a low voltage supply $V_{SS}$ 414. The beta-multiplier reference circuit 404 includes (1) a PMOS current mirror of transistors P21 416 and P22 420, (2) a NMOS current mirror of transistors N21 424 and N22 428, (3) a resistor R21 432, and (4) an output section of transistor P23 436 and resistor R22 440. The output transistor N22 428 of the NMOS mirror has a width K times larger than the input transistor N21 424. Neglecting mismatch and λ effects, if the reference circuit 404 is operating in the active state, then the PMOS and NMOS mirrors force currents I1 and I2 to match. As a result, the gate-to-source voltages of the NMOS mirror transistors are governed by the equation $V_{GSN21}=V_{GSN22}+IR$. Substituting transistor operating formulas for the gate-to-source voltages, it is found that the reference current I2 is proportional to an equation based on (1) the value of the resistor R, (2) the value of beta for transistor N21, and (2) the value of K. Therefore, the reference current I2 value is not directly dependent on the power supply $V_{CC}$ 412.

The prior art start-up circuit 408 includes (1) a current reference transistor N23 460, (2) a current supply transistor P24 464, and (3) a switching transistor P25 456. When the integrated circuit is powered OFF, $V_{CC}$ 412 and $V_{SS}$ 414 are at the same level. When the integrated circuit is first powered ON, $V_{CC}$ 412 immediately rises to a high level with respect to $V_{SS}$ 414. At that moment, the capacitance of transistor N23 460 will cause the initial voltage Start 468 to stay at a low level. Therefore, the gate of transistor P25 456 is pulled toward $V_{SS}$ 414, and the transistor is turned ON. Transistor P25 456 will conduct current to pull voltage VBN 448 towards $V_{CC}$ 412. This will cause current I1 to flow through transistor N21 424 and elevated voltage VBN 448 such that mirror input transistor N21 424 and output transistor N22 428 are ON. Output current I2 will flow through N22 428 to induce gate voltage VBP 452 onto PMOS mirror input transistor P22 420 and output transistor P21 416. This will cause current I1 to flow. At this point all of the transistors in the beta-multiplier circuit are ON, and the circuit is in the active state. Voltage VBP 452 will bias output transistor P23 436 and induce current I3 through output resistor R22 440 to generate the voltage reference VREF 444. The start-up circuit 408 is designed such that the transistor P24 464 will dominate a voltage divider created by transistors P24 464 and N23 460. As a result, the voltage Start 468 rapidly rises toward $V_{CC}$ 412 until transistor P25 456 is shut OFF. Once P25 shuts OFF, the beta-multiplier circuit 404 will settle to the active state operating point as described above.

There are two practical problems with this prior art implementation. First, the current conducted through the self-biased reference circuit 404 during start-up will substantially exceed the nominal, or steady-state, level to cause much higher power consumption. This higher current is due to a large bias voltage VBN 448 forced onto the NMOS mirror input transistor N21 424 during start-up. Further, the large start-up inrush current I1 is replicated in current I2 and output current I3, as well as any other branches referenced to the voltage VBP 452. These large currents are not compatible with low-power operation and can be a serious problem for switched capacitor (SC) filters, dynamic bias circuits, and other sensitive analog circuits. A second problem is that, even during steady, active state operation, the output current I2 of the beta-multiplier circuit 404 has a strong supply voltage dependence (low output impedance). The simple, single-stage PMOS and NMOS current mirrors are influenced by variation in the supply voltage $V_{CC}$ 412 to cause modulation of the currents I1 and I2 (and all subsequent reproductions). Therefore, the current and voltage references from the prior art circuit are not optimal.

Referring now to FIG. 6, a circuit schematic block diagram illustrates a prior art, self-biased reference circuit 500 that attempts to address these two issues. A beta-multiplier circuit 504 is formed with cascode-type current mirrors 516 and 518. These cascode current mirrors 516 and 518 have higher output impedance than the simple current mirrors of the prior art circuit in FIG. 5. Referring again to FIG. 6, the NMOS cascode current mirror 516 includes transistors N1 520, NC1 524, N2 528, and NC2 532. The NMOS transistors form two stacked mirrors. Each mirror is self-biasing from the input current I1, has high output impedance and low offset error. The NMOS cascode mirror 516 requires a minimum input voltage of two diode drops and exhibits an output compliance voltage of about one diode drop plus a saturation voltage. The resistor R0 534 in the source path of N2 528 overlays the beta-multiplier function onto the output current I2. The PMOS cascode current mirror 518 includes transistors P1 544, PC1 548, P2 552, and PC2 556. The PMOS transistors are configured as a low-voltage, cascode current mirror. In this configuration, the minimum required input voltage drop for the mirror is only a single diode drop while the output compliance voltage is two saturation voltages. To achieve low minimum input voltage operation, the PMOS cascode current mirror 518 requires an additional cascode bias voltage VPC 568. This cascode bias voltage VPC 568 is generated by diode-connected transistor PC3 560. Transistors N3 574, N4 576, P4 570, and PC4 572 allow the PMOS bias voltages VP 564 and VPC 568 to mirror the reference current $I_{ref}$ to the bias voltage generating transistor PC3 560. Transistors P5 580 and PC5 582 and resistor R1 584 are used to generate reference voltage VREF 586.

The prior start-up circuit 508 includes (1) switch transistor NST 588, (2) current source transistor N5 590, and (3) capacitor $C_{ST}$ 592. Immediately after powering up the integrated circuit, the voltage START 594 will be about the same as the supply voltage $V_{CC}$ 512 due to the presence of the capacitor $C_{ST}$ 592. As a result, the switch transistor NST 588 will be biased to the ON state. Transistor NST 588 will therefore connect together the nodes VPC 568 and VNC 540 which will cause current to flow in the NMOS and PMOS current mirrors 516 and 518. The reference current $I_{REF}$ will bias diode-connected transistor N4 576 to generate a bias voltage 578 that is further connected to current source transistor N5 590. Current source transistor N5 590 discharges the capacitor $C_{ST}$ 592 such that the START voltage 594 is eventually pulled to below the turn-on voltage for NST 588. At this point, the start-up circuit 508 is disabled, and the bias-multiplier circuit 504 is allowed to settle to steady state.

It is found that minimum operating supply voltage, or headroom voltage, for the prior art beta-multiplier circuit 504 is governed by the left branch of each current mirror 516 and 518, composed of the diode-connected, NMOS transistors N1 520 and NC1 524 and the PMOS transistors P1 544 and PC1 548. The transistors N1 520 and NC1 524 are typically biased in the sub-threshold region since this operating mode reduces the effect of the R0 tolerance. In this operating mode, the minimum voltage headroom necessary to operate the beta-multiplier circuit 504 is found to be about two NMOS transistor diode drops plus two PMOS transistor saturation voltages, or about $V_{CCmin}=2V_{TN}+2V_{DSATP}$.

It is further found that the prior art start-up circuit 508 requires a minimum supply voltage of about two NMOS transistor diode drops plus one NMOS transistor drain-to-source voltage and one PMOS transistor gate-to-source voltage, or about $V_{CCmin}=2V_{TN}+2V_{DSN}+V_{GSP}$. This minimum supply voltage includes the voltage across the NMOS diode-connected transistors N1 520 and NC1 524, the drain-to-source drop of the switch transistor NST 588, and the gate-to-source drop of the voltage bias transistor PC3 560. In addition, the voltage necessary to turn ON the start-up switch transistor NST 588 is found to be in excess of $V_{START}=2V_{TN}+V_{GSNST}$. This analysis reveals the main disadvantage of the prior art start-up circuit 508. Namely, the minimum supply voltage $V_{CCmin}$ necessary for the correct operation of the start-up circuit 508 is found to be higher than the minimum supply voltage $V_{CCmin}$ required to operate the beta-multiplier current 504. To optimize the combined reference circuit 500, it is essential that the start-up minimum supply voltage be reduced.

SUMMARY OF THE INVENTION

A principal object of the present invention is to provide an improved self-biased reference circuit device.

A further object of the present invention is to provide a self-biased reference circuit device with an improved start-up circuit.

Another further object of the present invention is to provide a self-biased reference circuit device with a start-up circuit with a reduced minimum operating supply voltage.

Another further object of the present invention is to provide an improved method to start-up a self-biased reference circuit.

In accordance with the objects of this invention, an improved self-biased reference circuit device is achieved. The self-biased reference circuit device includes a first cascode current mirror, a second cascode current mirror, and a startup circuit. The first cascode current is capable to generate first and second bias voltages in response to a first current and to generate a second current in response to the first and second bias voltages. The second cascode current mirror is capable to generate a third bias voltage in response to the second current, to generate a fourth bias voltage in response to a third current, and to generate the first current in response to the third and fourth bias voltages. The startup circuit includes first and second switches. The first switch is capable to connect the first and fourth bias voltages during startup. The second switch is capable to connect the third bias voltage and an inner drain-source connection in the output stage of the first cascode current mirror during startup.

Also in accordance with the objects of this invention, another improved self-biased reference circuit device is achieved. The self-biased reference circuit device includes a first cascode current mirror, a second cascode current mirror, and a startup circuit. The first cascode current mirror is capable to generate a first bias voltage in response to a first current, to generate a second bias voltage in response to a fourth current, and to generate a second current in response to the first and second bias voltages. The second cascode current mirror is capable to generate a third bias voltage in response to the second current, to generate a fourth bias voltage in response to a third current, and to generate the first current in response to the third and fourth bias voltages. The startup circuit includes first and second switches. The first switch is capable to connect the first and fourth bias voltages during startup. The second switch is capable to connect the second and third bias voltages during startup.

Also in accordance with the objects of this invention, an improved method to startup a self-biased reference circuit is achieved. First and second cascode current mirrors are provided. The first cascode current mirror is capable to generate first and second bias voltages in response to a first current and to generate a second current in response to the first and second bias voltages. The second cascode current mirror is capable to generate a third bias voltage in response to the second current, to generate a fourth bias voltage in response to a third current, and to generate the first current in response to the third and fourth bias voltages. The first and fourth bias voltages are connected. The third bias voltage is connected to an inner drain-source connection in the output stage of the first cascode current mirror. Subsequently, the first and fourth bias voltages are unconnected and the third bias voltage is unconnected from the inner drain-source connection.

Also in accordance with the objects of this invention, another improved method to startup a self-biased reference circuit is achieved. First and second cascode current mirrors are provided. The first cascode current mirror is capable to generate a first bias voltage in response to a first current, to generate a second bias voltage in response to a fourth current, and to generate a second current in response to the first and second bias voltages. A second cascode current mirror is capable to generate a third bias voltage in response to the second current, to generate a fourth bias voltage in response to a third current, and to generate the first current in response to the third and fourth bias voltages. The first and fourth bias voltages are connected. The second and third bias voltage are connected. Subsequently, the first and fourth bias voltages are unconnected and the second and third bias voltage are unconnected.

As such, a novel device and method are disclosed for starting up a low-voltage cascode beta-multiplier reference circuit that does not limit the minimum supply voltage required for the reference circuit. In the present invention, a novel and robust method and circuit device to start up a low-voltage cascode beta-multiplier reference circuit are described. The invention provides a simple start-up circuit that works at supply voltages lower than the minimum supply voltage needed to operate the reference circuit. The invention insures complete startup of the reference circuit via a novel dual-stage scheme. The invention works well with a low-voltage, cascode beta-multiplier design. Other advantages will be recognized by those of ordinary skill in the art.

BRIEF DESCRIPTION OF THE DRAWINGS

The present invention and the corresponding advantages and features provided thereby will be best understood and appreciated upon review of the following detailed description of the invention, taken in conjunction with the following drawings, where like numerals represent like elements, in which:

FIG. 5 is a circuit schematic block diagram illustrating a prior art, self-biased reference circuit; and FIG. 6 is a circuit schematic block diagram illustrating a prior art, self-biased reference circuit.

DETAILED DESCRIPTION OF THE INVENTION

Figure 1:
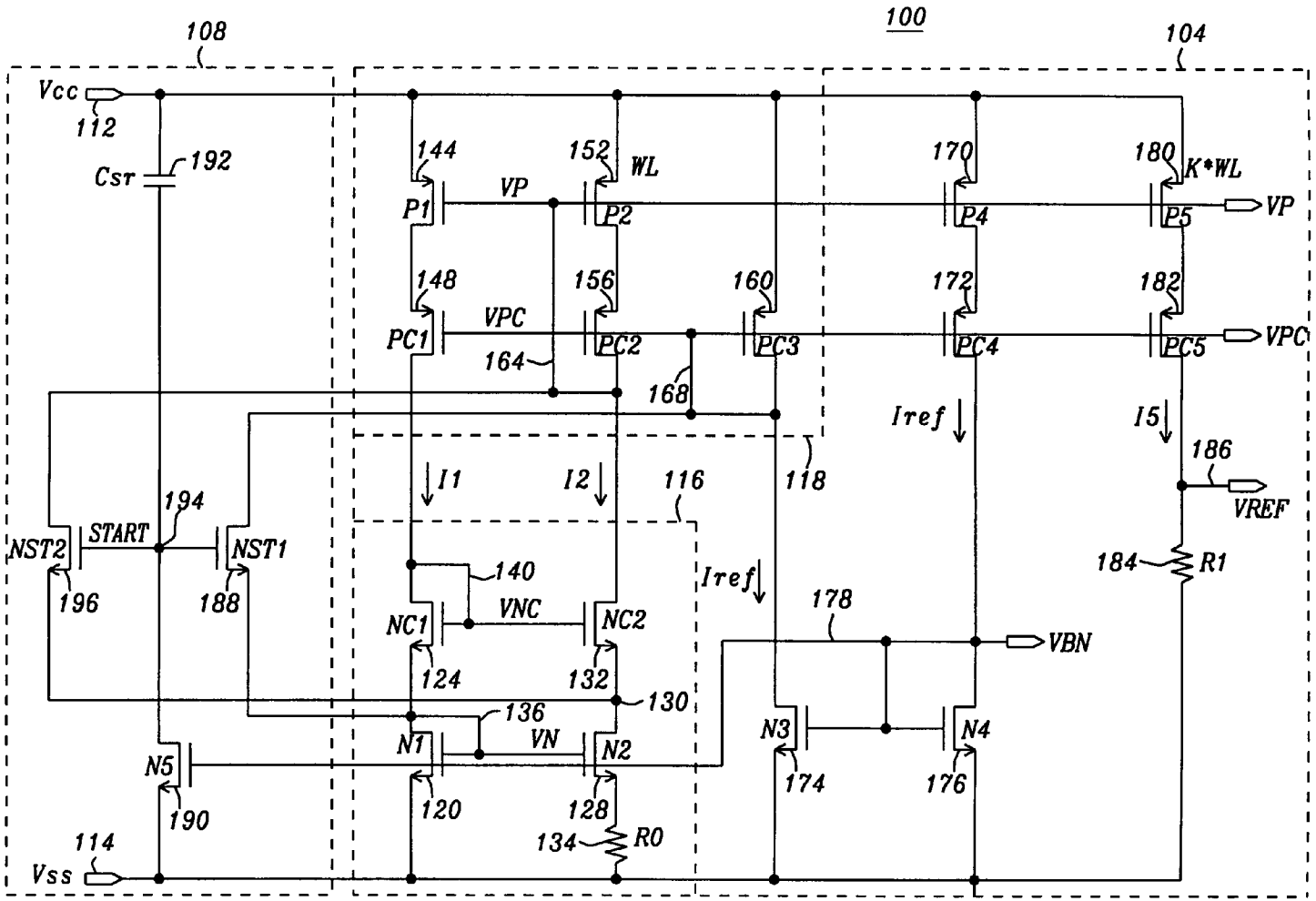
FIG. 1 is a circuit schematic diagram illustrating one example of a self-biased reference circuit in accordance with one embodiment of the invention.

FIG. 1 is a circuit schematic diagram illustrating one example of a self-biased reference circuit 100 in accordance with one embodiment of the invention. The self-biased reference circuit 100 includes a beta-multiplier circuit 104 and a start-up circuit 108. In this embodiment, the beta-multiplier circuit 104 is configured as in the prior art. The beta-multiplier circuit 104 includes a first cascode current mirror 116 and a second cascode current mirror 118. The first, or NMOS, cascode current mirror 116 includes transistors N1 120, NC1 124, N2 128, and NC2 132. These NMOS transistors form two stacked mirrors. Each of the NMOS stacked mirrors is self-biasing based on the input current I1, and has high output impedance and low offset error. The NMOS cascode current mirror 116 requires a minimum input voltage of about two diode drops and exhibits an output compliance voltage of about one diode drop plus a saturation voltage. A resistor R0 134 in the source path of transistor N2 128 is included to overlay the beta-multiplier function onto the output current I2. The NMOS cascode current mirror 116 generates first and second bias voltages, VN 136 and VNC 140, respectively, in response to the input current I1.

The second, or PMOS, cascode current mirror 118 includes transistors P1 144, PC1 148, P2 152, and PC2 156. The PMOS transistors are configured to form a low-voltage, cascode current mirror 118. This cascode current mirror 118 is operable at a reduced headroom voltage. In this configuration, the minimum required input voltage drop for the PMOS cascode current mirror 118 is only one diode while the output compliance voltage is about two saturation voltages. The PMOS cascode current mirror 118 generates third and fourth bias voltages, VP 164 and VPC 168, respectively, in response to input current I2. To achieve the low supply voltage operation, the PMOS cascode current mirror 118 requires that bias voltage VPC 168 be generated by flowing current through diode-connected transistor PC3 160. Transistors N3 174, N4 176, P4 170, and PC4 172 allow the third and fourth bias voltages VP 164 and VPC 168 to mirror the reference current $I_{ref}$ to the bias voltage generating transistor PC3 160. Transistors P5 180 and PC5 182 and resistor R1 184 are used to generate reference voltage VREF 186.

As an important feature of the present invention, a novel start-up circuit 108 is used. The start-up circuit 108 includes a first switch transistor NST1 188 and a second switch transistor NST2 196. The two-switch, or dual-stage, start-up circuit 108 can be successfully integrated in alternative beta-multiplier current references, such as the embodiment shown in FIG. 1 and the embodiment shown in FIG. 2. Referring again to FIG. 1, while the first and second switch transistors NST1 188 and NST2 196 are shown as NMOS transistors, it is understood that other embodiments may be substituted, such as PMOS transistors properly biased to turn ON during start-up. In addition, the start-up circuit 108 includes a current source transistor N5 190 and a capacitor $C_{ST}$ 192. It is further understood that these components may be replaced with other known embodiments, such as flipping the capacitor and transistor or replacing the NMOS transistor M5 190 with a PMOS transistor.

Referring again to FIG. 1, as another important feature of the present invention, the first switch transistor NST1 188 is coupled between the first bias reference VN 136 and the fourth bias reference VPC 168. The connection of the first switch transistor NST1 188 differs from that of the prior art where the single switching transistor is connected from the PMOS cascode bias voltage VPC to the NMOS cascode bias voltage VNC. By connecting to the lower NMOS transistor N1 120 of the NMOS cascode stack, the required turn-on voltage for the first switch transistor NST1 188 is reduced by one diode drop to about $V_{START1}=V_{TN1}+V_{GSNST1}$. Because of this key difference, the supply voltage required to allow current flow through start-up path controlled by the first switch transistor NST1 188 during start-up is reduced to about $V_{CCmin}=V_{TN1}+V_{DSNST1}+V_{GSPC3}$. Unlike the prior art, the minimum turn-on voltage and operating voltage for the first part of the start-up circuit 108—controlled by the first switch transistor NST1 188—are less than the minimum operating voltage $V_{CCmin}$ required for operation of the beta-multiplier circuit 104 so that this is not the limiting factor for low voltage operation of the overall circuit 100.

As another important feature of the present invention, the second switch transistor NST2 196 is coupled between the third bias voltage VP 164 and an inner drain-source connection 130. It is found that, while the current flowing through the first switch transistor NST1 188 during start-up provides the correct biasing of the node VPC 168 and the node VN 136, this alone does not guarantee proper start-up of the beta-multiplier circuit 104. The additional, second switch transistor NST2 196 ensures current flow in the output side of the NMOS cascode current mirror 116. In particular, the second switch transistor NST2 196 ensures current flow in the second start-up branch defined by transistors P2 152, PC2 156, NST2 196, and N2 128 where transistors PC2 156 and N2 128 are already enabled (pre-biased) by the operation of the first switch transistor NST1 188 and the first start-up branch. The required turn-on voltage for the second switch transistor NST2 196 is only about $V_{START2}=V_{DSN2}+V_{GSNST2}$. In addition, the supply voltage required to allow current flow through start-up path controlled by the second switch transistor NST2 196 during start-up is only about $V_{CCmin}=V_{DSN1}+V_{DSNST2}+V_{GSP2}$. Again, the minimum turn-on voltage and operating voltage for the second part of the start-up circuit 108—controlled by the second switch transistor NST2 196—are less than the minimum operating voltage $V_{CCmin}$ required for operation of the beta-multiplier circuit 104 so that this is not the limiting factor for low voltage circuit operation.

Immediately after powering up the integrated circuit, the voltage START 194 will be the about same as the supply voltage $V_{CC}$ 112 due to the presence of the capacitor $C_{ST}$ 192. As a result, the first switch transistor NST1 188 and the second switch transistor NST2 196 will be biased to an ON state. Transistor NST1 188 will connect together the nodes VPC 168 and VN 136 to cause current to flow in the NMOS and PMOS current mirrors 116 and 118. The reference current $I_{REF}$ will bias diode-connected transistor N4 176 to generate a bias voltage 178 that is further connected to the current source transistor N5 190 of the start-up circuit 108. Current source transistor N5 190 discharges the capacitor $C_{ST}$ 192 such that the START voltage 194 eventually falls to below the turn-on voltage for NST1 188. At this point, the start-up circuit 108 is disabled, and the bias-multiplier circuit 104 is allowed to settle to steady state.

The main function of the additional, second switch transistor NST2 196 is to ensure initial current flow 12 in transistor P2 152 of the right branch of the second cascode current mirror 118. Via the PMOS cascode mirror 118, and particularly transistors P1 144 and P2 152, this current I2 is mirrored to generate current I1 in the left-side branch. Current I1 then biases the VNC bias voltage 140 to turn ON the diode-connected NC1 124 transistor and the mirror transistor NC2 132. This final process completes the full start-up of the low voltage cascode beta-multiplier 104.

Figure 2:
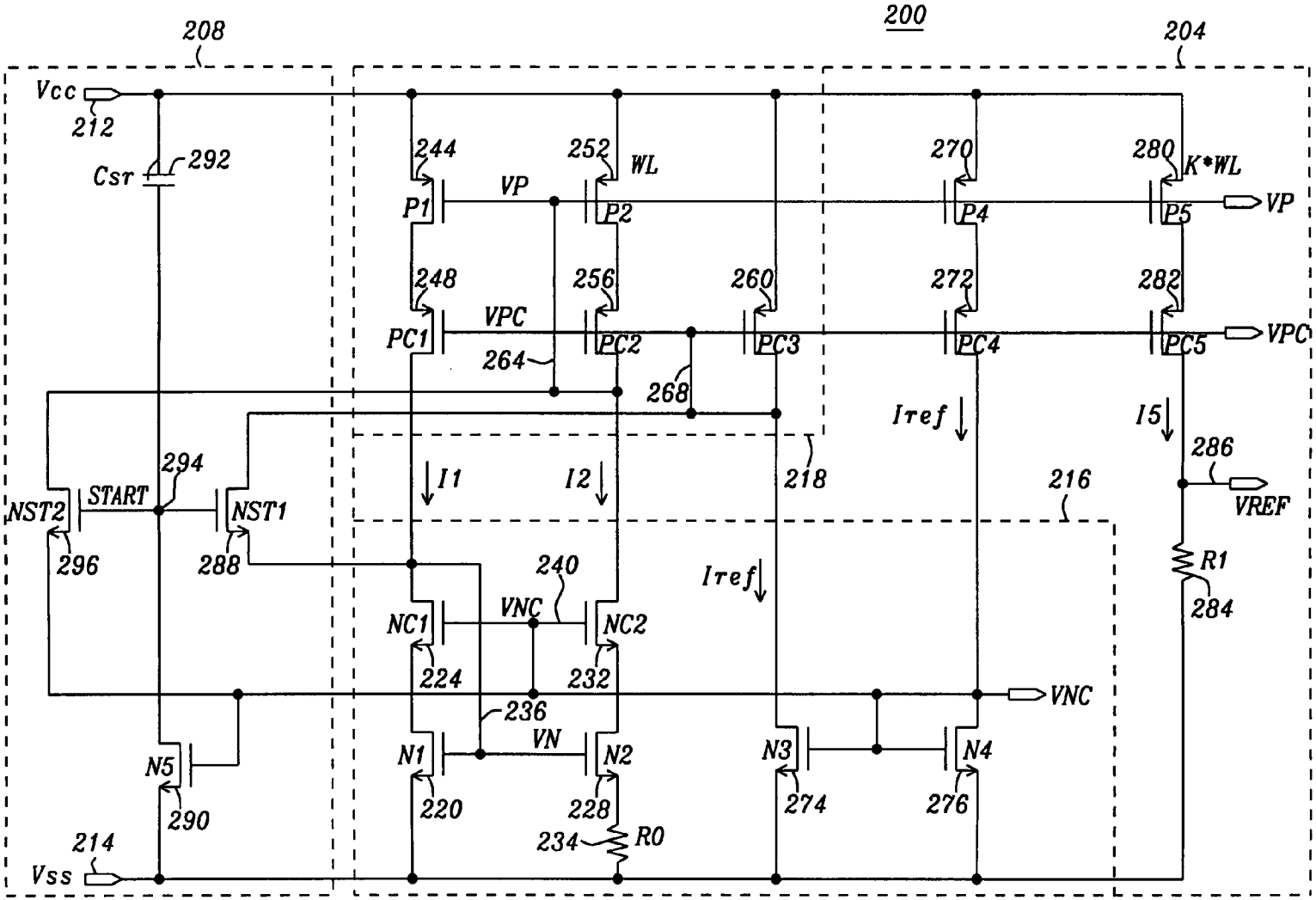
FIG. 2 is a circuit schematic diagram illustrating one example of a self-biased reference circuit in accordance with one embodiment of the invention.

FIG. 2 is a circuit schematic diagram illustrating one example of a self-biased reference circuit 200 in accordance with one embodiment of the invention. The novel dual stage start-up circuit 208 is successfully integrated in an alternative low voltage, cascode beta-multiplier reference 200. In this embodiment, both the beta-multiplier circuit 204 and the start-up circuit 208 are configured differently from the prior art. The beta-multiplier circuit 204 includes a first cascode current mirror 216 and a second cascode current mirror 218. In this case both the first and second cascode current mirrors 216 and 218 are configured as low-voltage cascode current references.

The first cascode current mirror 216 includes transistors N1 220, NC1 224, N2 228, and NC2 232. These NMOS transistors are configured to form a low-voltage, cascode current mirror 216. In this configuration, the minimum required input voltage drop for the NMOS cascode current mirror 216 is only one diode while the output compliance voltage is about two saturation voltages. A resistor R0 234 in the source path of transistor N2 228 is included to overlay the beta-multiplier function onto the output current I2. To achieve the low supply voltage operation, the NMOS cascode current mirror 216 requires that a second bias voltage VNC 240 be generated by flowing current $I_{ref}$ through diode-connected transistor NC4 276. The NMOS cascode current mirror 216 generates a first bias voltage VN 236 in response to the input current I1.

The second, or PMOS, cascode current mirror 218 includes transistors P1 244, PC1 248, P2 252, and PC2 256 as in the prior embodiment. The PMOS transistors are configured to form a low-voltage, cascode current mirror 218—that is a cascode current mirror operable at a reduced headroom voltage. In this configuration, the minimum required input voltage drop for the PMOS cascode current mirror 218 is only one diode while the output compliance voltage is about two saturation voltages. The PMOS cascode current mirror 218 generates third and fourth bias voltages, VP 264 and VPC 268, respectively, in response to input current I2. To achieve the low supply voltage operation, the PMOS cascode current mirror 218 requires that bias voltage VPC 268 be generated by flowing current through diode-connected transistor PC3 260. Transistors N3 274, N4 276, P4 270, and PC4 272 allow the third and fourth bias voltages VP 264 and VPC 268 to mirror the reference current $I_{ref}$ to the bias voltage generating transistor PC3 260. Transistors P5 280 and PC5 282 and resistor R1 284 are used to generate reference voltage VREF 286.

As an important feature of this embodiment of the present invention, a novel start-up circuit 208 is used. The start-up circuit 208 includes a first switch transistor NST1 288 and a second switch transistor NST2 296. While the first and second switch transistors NST1 288 and NST2 296 are shown as NMOS transistors, it is understood that other embodiments may be substituted, such as PMOS transistors properly biased to turn on during start-up. In addition, the start-up circuit 208 includes a current source transistor N5 290, and a capacitor $C_{ST}$ 292. It is further understood that these components may be replaced with other known embodiments such as flipping the capacitor and transistor or replacing the NMOS transistor M5 290 with a PMOS transistor.

As another important feature of this embodiment of the present invention, the first switch transistor NST1 288 is coupled between the first bias voltage VN 236 and the fourth bias voltage VPC 268. The connection of the first switch transistor NST1 288 again differs from that of the prior art where the single switching transistor is connected from the PMOS cascode bias voltage VPC to the NMOS cascode bias voltage VNC. By connecting to the gate of the lower NMOS transistor N1 220 of the NMOS cascode stack, the required turn-on voltage for the first switch transistor NST1 288 is again reduced by one diode drop to about $V_{START1}=V_{TN1}+V_{GSNST1}$. Because of this key difference, the supply voltage required to allow current flow through start-up path controlled by the first switch transistor NST1 288 during start-up is reduced to about $V_{CCmin}=V_{TN1}+V_{DSNST1}+V_{GSPC3}$. Unlike the prior art, the minimum turn-on voltage and operating voltage for the first part of the start-up circuit 208—controlled by the first switch transistor NST1 288—are less than the minimum operating voltage $V_{CCmin}$ required for operation of the beta-multiplier circuit 204 so that this is not the limiting factor for low voltage circuit operation.

As another important feature of this embodiment of the present invention, the second switch transistor NST2 296 is coupled between the second bias voltage VNC 240 and the third bias voltage VP 264. It is found that, while the current flowing through the first switch transistor NST1 288 during start-up provides the correct biasing of the node VPC 268 and the node VN 236, this alone does not guarantee proper start-up of the beta-multiplier circuit 204. The additional, second switch transistor NST2 296 ensures current flow in the output side of the NMOS cascode current mirror 216. In particular, the second switch transistor NST2 296 ensures current flow in the second start-up branch defined by transistors P2 252, PC2 256, NST2 296, NC2 232, and N2 228 where transistors PC2 256 and N2 228 are already enabled (pre-biased) by the operation of the first switch transistor NST1 288 and the first start-up branch. The required turn-on voltage for the second switch transistor NST2 296 is only about $V_{START2}=V_{TN4}+V_{GSNST2}$. In addition, the supply voltage required to allow current flow through start-up path controlled by the second switch transistor NST2 296 during start-up is only about $V_{CCmin}=V_{TN4}+V_{DSNST2}+V_{GSP2}$. Again, the minimum turn-on voltage and operating voltage for the second part of the start-up circuit 208—controlled by the second switch transistor NST2 296—are less than the minimum operating voltage $V_{CCmin}$ required for operation of the beta-multiplier circuit 204 so that this is not the limiting factor for low voltage circuit operation.

Immediately after powering up the integrated circuit, the voltage START 294 will be about the same as the supply voltage $V_{CC}$ 212 due to the presence of the capacitor $C_{ST}$ 292. As a result, the first switch transistor NST1 288 and the second switch transistor NST2 296 will be biased to an ON state. Transistor NST1 288 will connect together the nodes VPC 268 and VN 236 to cause current to flow in the NMOS and PMOS current mirrors 216 and 218. The reference current $I_{REF}$ will bias diode-connected transistor N4 276 to generate the second bias voltage 240 that is further connected to the current source transistor N5 290 of the start-up circuit 208. Current source transistor N5 290 discharges the capacitor $C_{ST}$ 292 such that the START voltage 294 eventually falls below the turn-on voltage for NST1 288. At this point, the start-up circuit 208 is disabled, and the bias-multiplier circuit 204 is allowed to settle to steady state.

The main function of the additional, second switch transistor NST2 296 is to ensure initial current flow 12 in transistor P2 252 of the right branch of the second cascode current mirror 218. Via the PMOS cascode mirror 218, and particularly transistors P1 244 and P2 252, this current I2 is mirrored to current I1 in the left-side branch. Current I1 then generates the VN bias voltage 236 to turn ON the diode-connected N1 220 transistor and mirror transistor N2 228. This final process completes the full start-up of the low voltage cascode beta-multiplier 204.

Figure 3:
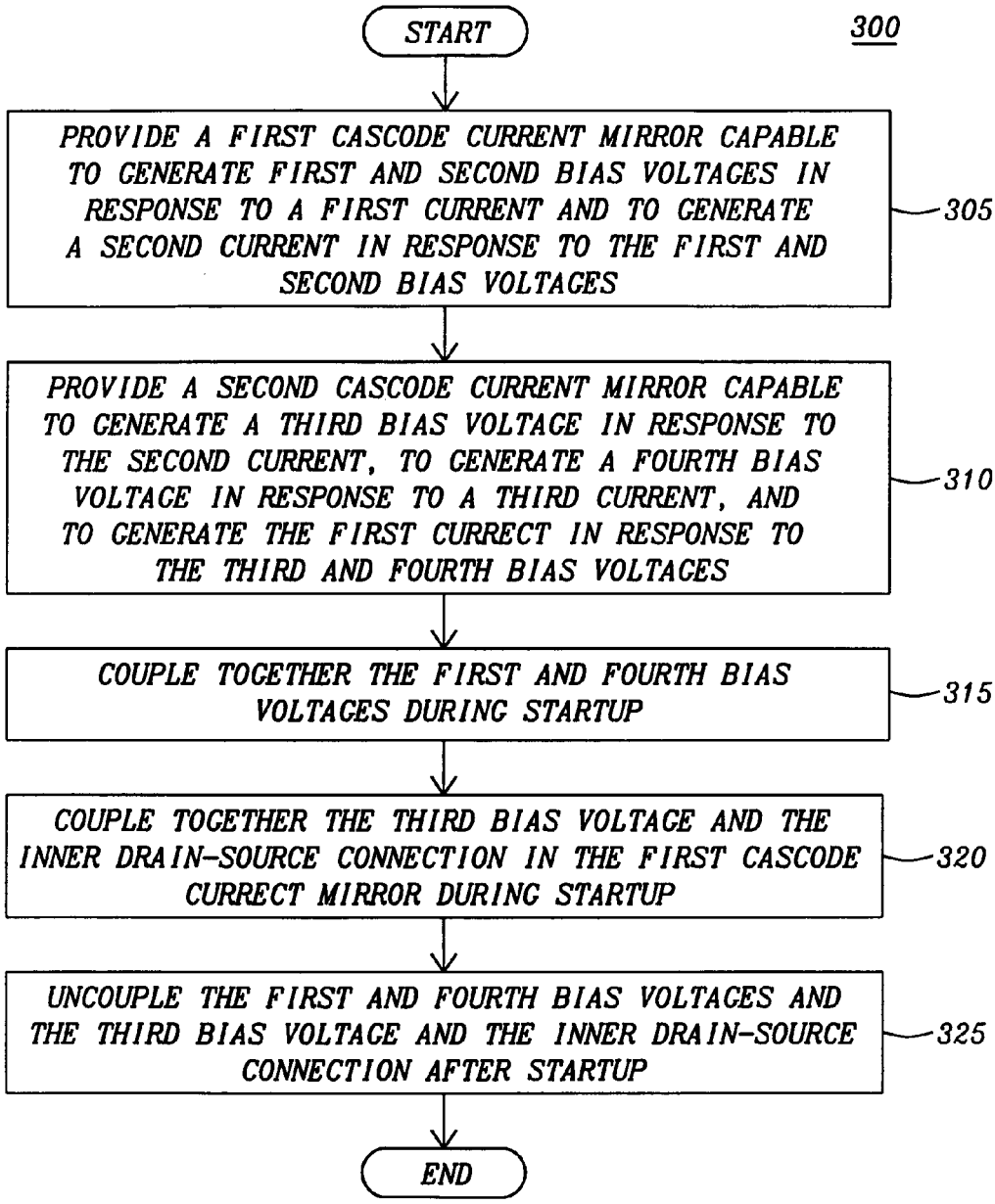
FIG. 3 is a flowchart illustrating one example of a method for starting up a self-biased circuit in accordance with one embodiment of the invention.

FIG. 3 is a flowchart illustrating one example of a method 300 for starting up a self-biased circuit in accordance with one embodiment of the invention. The flowchart method 300 shows operating steps performed to start-up a self-biased current reference, in general, and a beta-multiplier current reference in particular. In particular, one example of a method 300 performed by self-biased current reference 100 of FIG. 1 is shown. Referring again to FIG. 4, the method begins in step 305 where a first cascode current mirror 116 is provided. The current mirror 116 is capable to generate first and second bias voltages 136 and 140 in response to a first current I1 and to generate a second current I2 in response to the first and second bias voltages. In step 310, a second cascode current mirror 118 is provided. The current mirror 118 is capable to generate a third bias voltage 164 in response to the second current I2, to generate a fourth bias voltage 168 in response to third current $I_{ref}$, and to generate the first current I1 in response to the third and fourth bias voltages 164 and 168. In step 315, during start-up, the first and fourth bias voltages 136 and 168 are coupled together. In step 320, during start-up, the third bias voltage 164 and an inner drain-source connection 130 in the first cascode current mirror 116 are coupled together. In step 325, the first and fourth bias voltages 136 and 168 are uncoupled, and the third bias voltage 164 is uncoupled from the inner drain-source connection 130 after start-up.

Figure 4:
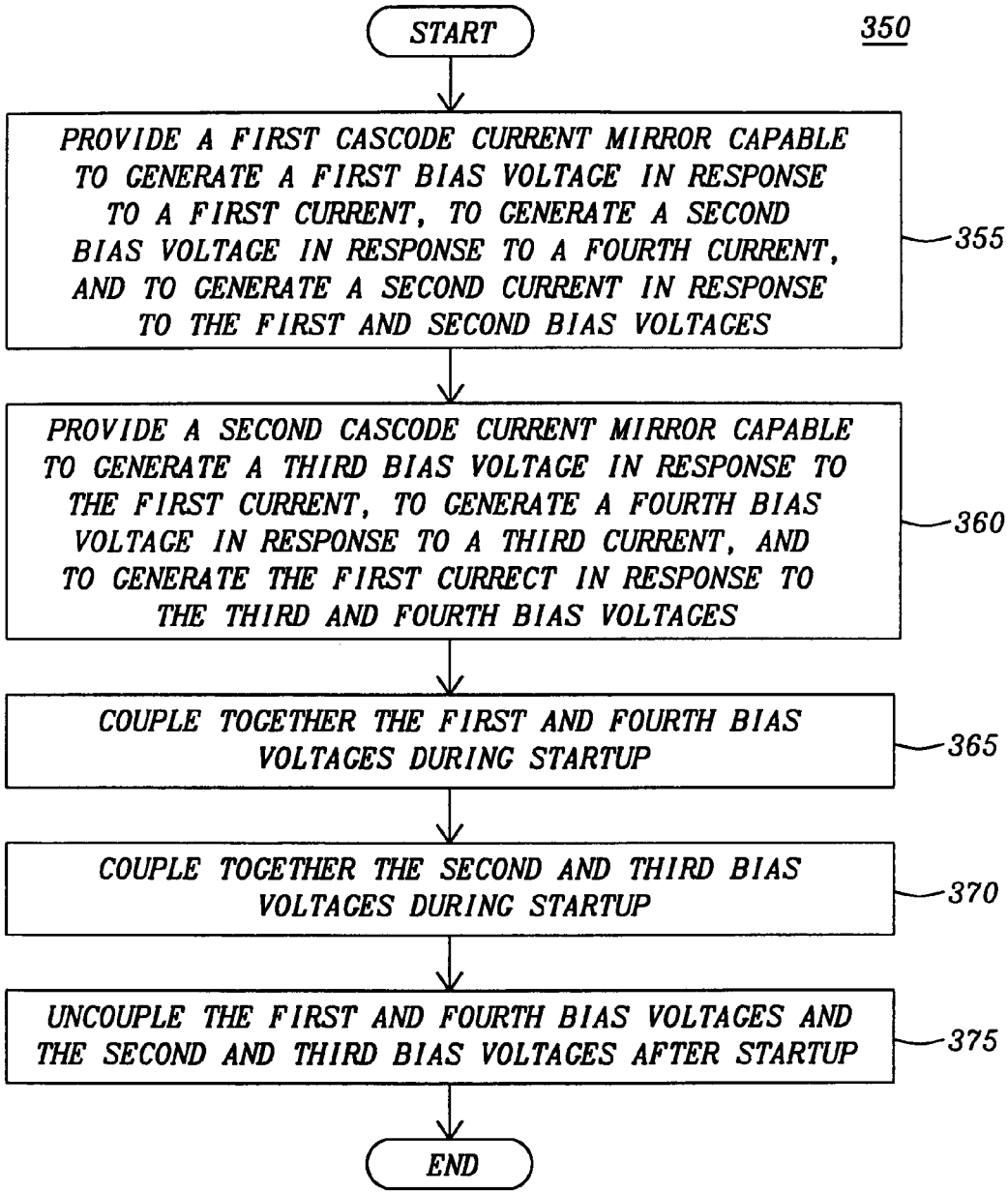
FIG. 4 is a flowchart illustrating one example of a method for starting up a self-biased circuit in accordance with one embodiment of the invention.

FIG. 4 is a flowchart illustrating one example of a method 350 for starting up a self-biased circuit in accordance with one embodiment of the invention. The flowchart method 350 shows operating steps performed to start-up a self-biased current reference, in general, and a beta-multiplier current reference in particular. In particular, one example of a method 350 performed by self-biased current reference 200 of FIG. 2 is shown. Referring again to FIG. 4, the method begins in step 355 where a first cascode current mirror 216 is provided. The current mirror 216 is capable to generate a first bias voltage 236 in response to a first current I1, to generate a second bias voltage 240 in response to a fourth current $I_{ref}$, and to generate a second current I2 in response to the first and second bias voltages. In step 360, a second cascode current mirror 218 is provided. The current mirror 218 is capable to generate a third bias voltage 264 in response to the second current I2, to generate a fourth bias voltage 268 in response to third current $I_{ref}$, and to generate the first current I1 in response to the third and fourth bias voltages 264 and 268. In step 365, during start-up, the first and fourth bias voltages 236 and 268 are coupled together. In step 370, during start-up, the second bias voltage 240 and the third bias voltage 364 are coupled together. In step 375, the first and fourth bias voltages 236 and 268 are uncoupled, and the second and third bias voltages 240 and 264 are uncoupled after start-up A novel device and method are disclosed for starting up a low-voltage cascode beta-multiplier reference circuit that does not limit the minimum supply voltage required for the reference circuit. In the present invention, a novel and robust method and circuit device to start up a low-voltage cascode beta-multiplier reference circuit is described. The invention provides a simple start-up circuit that works at supply voltages lower than the minimum supply voltage needed to operate the reference circuit. The invention insures complete startup of the reference circuit via a novel dual-stage scheme. The invention works well with a low-voltage, cascode beta-multiplier design.

The above detailed description of the invention, and the examples described therein, has been presented for the purposes of illustration and description. While the principles of the invention have been described above in connection with a specific device, it is to be clearly understood that this description is made only by way of example and not as a limitation on the scope of the invention.

What is claimed is:

1. A self-biased reference circuit device, said device comprising:

a first cascode current mirror operable to generate first and second bias voltages in response to a first current and to generate a second current in response to the first and second bias voltages;

a second cascode current mirror operable to generate a third bias voltage in response to the second current, to generate a fourth bias voltage in response to a third current, and to generate the first current in response to the third and fourth bias voltages; and a startup circuit comprising a first switch in a first start-up branch and a second switch in a second start-up branch, wherein the first switch is operable to communicatively couple the first and fourth bias voltages during startup and wherein the second switch is operable to communicatively couple the third bias voltage and an inner drain-source connection in the output stage of the first cascode current mirror during startup, where, enabled by said first start-up branch, said second switch ensures current flow in said second start-up branch.

2. The device of claim 1 further comprising a resistor communicatively coupled between the first cascode current mirror and a voltage source.

3. The device of claim 1 wherein the first and second switches are transistors.

4. The device of claim 1 wherein the startup circuit further comprises a timing means operable to control the timing of the first and second switches.

5. The device of claim 4 wherein the timing means comprises a transistor and a capacitor.

6. The device of claim 1 wherein the first cascode current mirror comprises first, second, third, and fourth transistors, wherein the first and second transistors are cascode-stacked and diode-connected, wherein the third and fourth transistors are cascode-stacked, wherein the drain and gate of the first transistor are communicatively coupled to the gate of the third transistor and correspond to the first bias voltage, wherein the drain and gate of the second transistor are communicatively coupled to the gate of the fourth transistor and correspond to the second bias voltage.

7. The device of claim 6 further comprising a resistor communicatively coupled between the source of the third transistor and a voltage source.

8. The device of claim 1 wherein the second cascode current mirror comprises first, second, third, fourth, and fifth transistors, wherein the first and second transistors are cascode-stacked, wherein the third and fourth transistors are cascode-stacked, wherein the gates of the first and third transistors are communicatively coupled to the drain of the fourth transistor and correspond to the third bias voltage, wherein the fifth transistor is diode-connected, and wherein the drain and gate of the fifth transistor is communicatively coupled to the gates of the second and fourth transistors and correspond to the fourth bias voltage.

9. The device of claim 8 further comprising a resistor communicatively coupled between the source of the third transistor and a voltage source.

10. A self-biased reference circuit device, said device comprising:

a first cascode current mirror operable to generate a first bias voltage in response to a first current, to generate a second bias voltage in response to a fourth current, and to generate a second current in response to the first and second bias voltages;

a second cascode current mirror operable to generate a third bias voltage in response to the second current, to generate a fourth bias voltage in response to a third current, and to generate the first current in response to the third and fourth bias voltages; and a startup circuit comprising a first switch in a first start-up branch and a second switch in a second start-up branch, wherein the first switch is operable to communicatively couple the first and fourth bias voltages during startup, wherein the second switch is operable to communicatively couple the second and third bias voltages during startup, where, enabled by said first start-up branch, said second switch ensures current flow in said second start-up branch.

11. The device of claim 10 further comprising a resistor communicatively coupled between the first cascode current mirror and a voltage supply.

12. The device of claim 10 wherein the first and second switches are transistors.

13. The device of claim 10 wherein the startup circuit further comprises a timing means operable to control the timing of the first and second switches.

14. The device of claim 13 wherein the timing means comprises a transistor and a capacitor.

15. The device of claim 10 wherein the first cascode current mirror comprises first, second, third, fourth, and fifth transistors, wherein the first and second transistors are cascode-stacked, wherein the third and fourth transistors are cascode-stacked, wherein the gates of the first and third transistors are communicatively coupled to the drain of the second transistor and correspond to the first bias voltage, wherein the fifth transistor is diode-connected, and wherein the drain and gate of the fifth transistor is communicatively coupled to the gates of the second and fourth transistors and correspond to the second bias voltage.

16. The device of claim 15 further comprising a resistor communicatively coupled between the source of the third transistor and a voltage source.

17. The device of claim 10 wherein the second cascode current mirror comprises first, second, third, fourth, and fifth transistors, wherein the first and second transistors are cascode-stacked, wherein the third and fourth transistors are cascode-stacked, wherein the gates of the first and third transistors are communicatively coupled to the drain of the fourth transistor and correspond to the third bias voltage, wherein the fifth transistor is diode-connected, and wherein the drain and gate of the fifth transistor is communicatively coupled to the gates of the second and fourth transistors and correspond to the fourth bias voltage.

18. A method to startup a self-biased reference circuit, said method comprising:

providing a first cascode current mirror operable to generate first and second bias voltages in response to a first current and to generate a second current in response to the first and second bias voltages;

providing a second cascode current mirror operable to generate a third bias voltage in response to the second current, to generate a fourth bias voltage in response to a third current, and to generate the first current in response to the third and fourth bias voltages;

communicatively coupling together the first and fourth bias voltages during startup;

communicatively coupling together the third bias voltage and an inner drain-source connection in the first cascode current mirror during startup;

thereafter uncoupling the first and fourth bias voltages and the third bias voltage and the inner drain-source connection in the first cascode current mirror;

providing a start-up circuit comprising a first and a second start-up branch; and ensuring current flow in said second start-up branch when enabled by said first start-up branch.

19. The method of claim 18 wherein the steps of communicatively coupling and uncoupling are timed by charging a capacitor.

20. The method of claim 18 wherein the steps of communicatively coupling and uncoupling are accomplished by transistors.

21. A method to startup a self-biased reference circuit, said method comprising:

providing a first cascode current mirror operable to generate a first bias voltage in response to a first current, to generate a second bias voltage in response to a fourth current, and to generate a second current in response to the first and second bias voltages;

providing a second cascode current mirror operable to generate a third bias voltage in response to the second current, to generate a fourth bias voltage in response to a third current, and to generate the first current in response to the third and fourth bias voltages;

communicatively coupling together the first and fourth bias voltages during startup;

communicatively coupling together the second and third bias voltages during startup;

thereafter uncoupling the first and fourth bias voltages and the second and third bias voltages;

providing a start-up circuit comprising a first and a second start-up branch; and ensuring current flow in said second start-up branch when enabled by said first start-up branch.

22. The method of claim 21 wherein the steps of communicatively coupling and uncoupling are timed by charging a capacitor.

23. The method of claim 21 wherein the steps of communicatively coupling and uncoupling are accomplished by transistors.

* * * * *